United States Patent [19]

Bailey

[11] Patent Number: 4,744,898

[45] Date of Patent: May 17, 1988

[54] INFLATABLE SCREEN CLAMP

[75] Inventor: Marshall G. Bailey, Banchory, Scotland

[73] Assignee: Thule United Limited, Aberdeen, Scotland

[21] Appl. No.: 871,756

[22] Filed: Jun. 9, 1986

[30] Foreign Application Priority Data

Jun. 13, 1985 [GB] United Kingdom ..... 8514982

[51] Int. Cl.[4] ..... B07B 1/28

[52] U.S. Cl. ..... 210/236; 610/384; 610/388; 610/445; 610/495; 209/399; 209/403; 209/405

[58] Field of Search ..... 210/324, 350, 384, 388, 210/495, 499, 236, 445, 450; 209/403, 405, 399

[56] References Cited

U.S. PATENT DOCUMENTS

| | | | |
|---|---|---|---|
| 3,176,843 | 1/1962 | Hoskins et al. | 209/403 |
| 3,256,992 | 6/1966 | Eiling | 210/251 |
| 3,968,033 | 7/1976 | Illemann et al. | 209/403 |
| 4,082,657 | 4/1978 | Gage | 209/405 |
| 4,568,455 | 2/1986 | Huber et al. | 209/405 |
| 4,582,597 | 4/1986 | Huber | 209/403 |

FOREIGN PATENT DOCUMENTS

| | | | |
|---|---|---|---|
| 1326260 | 3/1963 | France | 209/403 |
| 839611 | 6/1981 | U.S.S.R. | 209/405 |

*Primary Examiner*—Richard V. Fisher
*Assistant Examiner*—Richard D. Jordon
*Attorney, Agent, or Firm*—Oblon, Fisher, Spivak, McClelland & Maier

[57] ABSTRACT

A clamping device for a screen member in vibratory screening apparatus comprises a frame member 1 on which is mounted an inflatable stocking 7. In use, the clamping device is inserted into the basket 21 of the screening apparatus so as to overlie the screen member, and the inflatable stocking 7 is expanded so as to press the screen member against a portion 17, 19, 31 of the basket 21 while the clamping device reacts against a further portion 17, 19, 33 of the basket 21. This pressure from the stocking 7 holds the screen member in place. Preferably the screen member has a screen 13 mounted in a frame 15 and the stocking 7 presses against this screen frame 15. The stocking 7 may press against the periphery of the screen member only or may press against other parts of the screen member as well.

5 Claims, 2 Drawing Sheets

INFLATABLE SCREEN CLAMP

FIELD OF INVENTION

This invention concerns the mounting of screens in vibratory apparatus such as is used for the sifting of mud and the like materials derived from oil-well drilling.

BACKGROUND TO THE INVENTION

It is known to mount a screen in a frame and mount the latter in a basket mounted within a machine housing adapted to be oscillated or otherwise vibrated as by a cam drive mechanism.

For servicing and replacement it is desirable to be able to remove the screen and its associated frame where provided, from the machine, and to this end the latter is adapted to be slid into and out of the basket and clamping means is provided to hold the frame and screen in position. Clearly it is desirable that the clamping shall be effected as quickly as possible to reduce down time.

It is known to make the frame for the screen inflatable, in order to provide a means for tensioning the screen within the vibratory apparatus. In EP-A-0130744 there is proposed a screen having an inflatable screen frame which on inflation both tensions the screen and clamps it in position in the screening device. However, this arrangement is of limited application. Since the inflation of the screen frame both clamps the screen in position and tensions it, the arrangment cannot be used with screens which are to be tensioned in some other manner such as by a tensioning clip or screw on the basket of the vibratory apparatus or which are pretensioned within a rigid frame. Additionally, since the same act of inflation both clamps the screen and tensions it, the clamping force and the tensioning force cannot be controlled independently. Finally, it is necessary for each screen to be associated with its own respective clamping arrangement, since this is incorporated in the screen frame, even when the screen is not mounted within a vibratory screening apparatus, and thus it is necessary to fabricate as many inflatable frames as there are screens.

It is therefore an object of the present invention to provide an improved clamping mechanism.

SUMMARY OF THE INVENTION

In accordance with first aspect of the present invention there is provided a clamping device for a screen member in vibratory screening apparatus, the device comprising a frame member and inflatable means on the frame member, whereby the device can be inserted into said apparatus to overlie at least a part of a screen member and the inflatable means can be inflated to press against a part of the screen member so as to clamp the screen member in position in the apparatus.

In accordance with a second aspect of the present invention there is provided a method of clamping a screen member in vibratory screening apparatus in which a clamping device comprising a frame member and inflatable means on the frame member is inserted into the apparatus to overlie at least a part of the screen member and the inflatable means is inflated to press against a part of the screen member so as to clamp the screen member in position in the apparatus.

The clamping device may be arranged to be inserted either above or below the screen member.

Preferably the inflatable means comprises at least one inflatable member located around the periphery of the frame member. The inflatable means may also comprise a portion located within the area defined by the frame member and spaced from its periphery. Preferably the inflatable member ovelies at least part of the edge region of the screen member.

The screen member may or may not include a screen frame in which the actual screen is located. However, in normal use a screen member comprising a screen in a frame will be used and the clamping device and the screen member are designed or selected relative to each other so that the inflatable means of the clamping device presses against the screen frame and not the screen itself.

Normally the screen member and the clamping device will be mounted in a basket of the vibratory screening apparatus and the inflatable means will press the screen member against part of the basket.

Hereinafter the frame member of the clamping device will be referred to as an intermediate frame member, for distinction over the screen frame.

The screen may be insertable into the apparatus untensioned, and may be tensioned subsequently (post-tensioning) against the body of the vibratory apparatus. Alternatively if the screen is located in a frame, the screen may be tensioned against the screen frame, and this may take the form of pre-tensioning the screen against the screen frame before insertion into the vibratory apparatus. Embodiments of the present invention may be used with pre-tensioned screens or post-tensioned screens. Our earlier applications GB-A-No. 2161715 and GB-A-No. 2162091 disclose permanently pre-tensioned screens with which embodiments of the present invention may be used.

Preferably means is provided to enable the inflated member to be deflated to enable the screen and if desired also the intermediate frame member to be withdrawn for servicing or replacement.

The inflatable member may for example be in the form of an elastomeric stocking which is secured to edge regions of the intermediate frame member so that when inflated and enlarged the increased cross-section of the stocking squeezes firmly against one surface of the screen or the frame surrounding the screen and clamps it securely in position against the peripheral regions of the supporting structure. In this way the screen and/or its bounding frame is/are sandwiched between the basket on the one hand and the intermediate frame member on the other.

Conveniently the stocking extends around at least three sides of the intermediate frame member and preferably also the fourth side.

The means for inflating the stocking or other device may be mounted on and form an integral part of the overall apparatus or pressurized fluid or an airline connection may be provided on the stocking or on its associated intermediate frame member to enable the stocking to be inflated from a separate air supply or hydraulic fluid supply.

Whichever arrangement is used there is preferably also provided a venting device by which the pressure in the stocking can be relieved. Where the inflating fluid is a hydraulic oil or other liquid the venting device preferably communicates with a reservoir of the liquid so that as the latter is exhausted from the stocking the oil can be returned to a common reservoir and is thereby saved.

BRIEF DESCRIPTION OF THE DRAWINGS

Embodiments of the present invention, given by way of nonlimitative example, will now be described with reference to the accompanying drawings, in which.

DETAILED DESCRIPTION OF THE EMBODIMENTS

Figure 1:
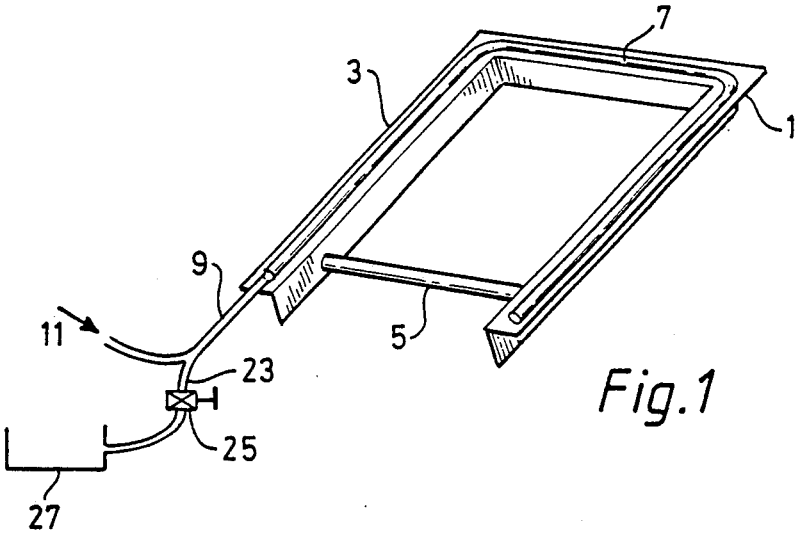
FIG. 1 is a schematic view of a first embodiment of the present invention.
Figure 2:
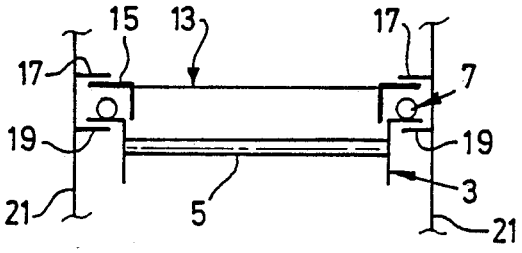
FIG. 2 is a schematic sectional view showing the embodiment of FIG. 1 and a screen member mounted in a basket of vibratory apparatus.

In FIGS. 1 and 2 a clamping device has an intermediate frame member 1 comprising an L-section portion 3 extending around three sides of a rectangle to form a U-shape, and a strut 5 across the mouth of the U to provide strength and rigidity. The frame member 1 is made of a relatively strong and rigid material such as steel.

The L-section 3 carries an inflatable tube or stocking 7 along the length of its upper surface. One end of the stocking 7 is extended to provide a supply line 9 by means of which inflation fluid may be introduced as indicated by arrow 11.

In use, the clamping device of FIG. 1 is inserted together with a screen member, comprising a screen 13 mounted in a screen frame 15, between two lateral projections 17, 19 of a basket 21 of a vibratory screening machine. As is shown in FIG. 2, the screen member and the clamping device are arranged so that the screen frame 15 is opposed to the upper projection 17 of the basket and the L-section of the clamping device is opposed to the lower lateral projection 19 of the basket, with the inflatable stocking between the L-section 3 and the screen frame 15. For reasons of clarity, the vertical spacing of members has been exaggerated in FIG. 2 (and also in FIGS. 4 and 6).

Inflation of the stocking 7 causes it to expand, so that it presses the screen frame 15 tightly against the upper projection 17 of the basket 21. The clamping device is prevented from moving downwardly away from the screen member by reaction between the L-section portion 3 and the lower projection 19 of the basket 21. In this manner, the screen member comprising the screen 13 and the screen frame 15 is clamped in position in the basket 21.

In order to provide the said inflation of the stocking 7, pressurised fluid such as air or hydraulic fluid is provided through the supply line 9 as indicated by arrow 11. As shown in FIG. 1, the supply line 9 also has a branch 23 leading to a pressure relief valve 25. Valve 25 is kept normally closed, and may be opened to allow deflation of the stocking 7. Deflation of the stocking 7 releases the clamping action on the screen frame 15, so that the screen member can be removed from the basket 21 for cleaning, replacement etc.

It may be desirable, especially when the inflation fluid for the stocking 7 is not compressed air, for inflation fluid exhausted through the valve 25 to be recovered. For this purpose, the branch 23 in the supply line may be extended beyond the valve 25 to a reservoir, indicated schematically in FIG. 1 at 27, where exhausted fluid may be collected.

Figure 3:
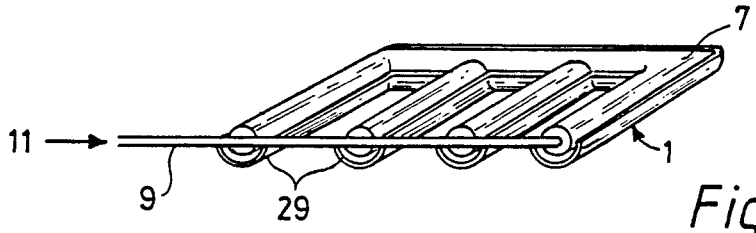
FIG. 3 is a schematic view of a second embodiment of the present invention.

FIG. 3 shows an alternative embodiment of the clamping device of the present invention. In this embodiment, the intermediate frame member 1 is formed from a semi-circular section member 29, which again may be of steel. The inflatable stocking 7 lies within the concavity of the semi-circular section.

In FIG. 3, the semi-circular sectioned portion 29 and the stocking 7 extend around three sides of a rectangle, as did the L-section portion 3 and the stocking 7 in FIG. 1. However, in addition the semi-circular section portion 29 and the stocking 7 have two longitudinal portions extending across the rectangle thus defined.

The pressurised fluid supply line 9 extends along the fourth side of the rectangle and is connected to the stocking 7 at the ends of the adjacent two sides of the rectangle and the ends of the two portions extending across the rectangle. Preferably, the supply line 9 is relatively rigid or is supported on a relatively rigid member at least where it forms the fourth side of the rectangle so as to increase the strength and rigidity of the clamping device as a whole.

Figure 4:
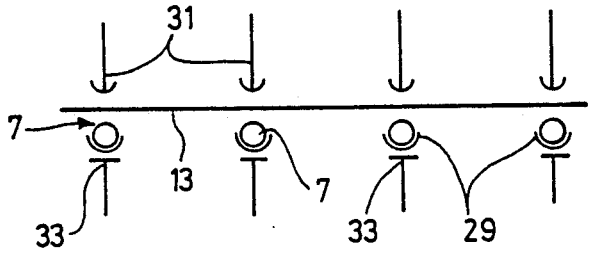
FIG. 4 is a schematic sectional view of the embodiment of FIG. 3 and a screen member mounted in a basket of vibratory apparatus.

As shown in FIG. 4, the clamping device of FIG. 3 is intended to be used with a basket 21 which provides clamping support members 31, 33 for the screen member at intermediate positions across the width of the screen member. Although the screen 13 of the screen member may extend across the positions of these intermediate support members 31, 33, it is preferred that the screen frame 15 divides the screen 13 into separate regions, and portions of the screen frame 15 are provided in the positions opposed to the supporting members 31, 33.

In use, the clamping device of FIG. 3 rests on the lower support members 33 of the basket 21, and the screen member is positioned between the stocking 7 of the clamping member and the upper support members 31. Preferably, the lower ends of the upper support members 31, which will contact the screen member directly, are of a resilient material such as rubber.

The clamping device of FIG. 3 is used in a manner similar to the clamping device of FIG. 1. The stocking 7 may be inflated to press the screen member against the upper support members 31, and the clamping device is itself supported by the lower support members 33.

Figure 5:
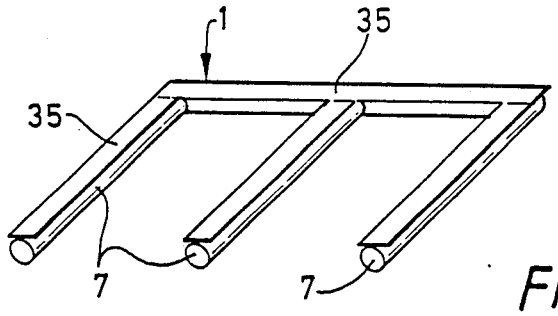
FIG. 5 is a schematic view of a third embodiment of the present invention.

FIG. 5 shows a third embodiment of the clamping device of the present invention. In this embodiment the intermediate frame member 1 comprises an E-shape formed from flat strip portions 35. The stocking 7 is bonded to the strip 35. The fluid supply line 9 is not shown in FIG. 5 but may be provided in a manner similar to that of FIG. 3.

Figure 6:
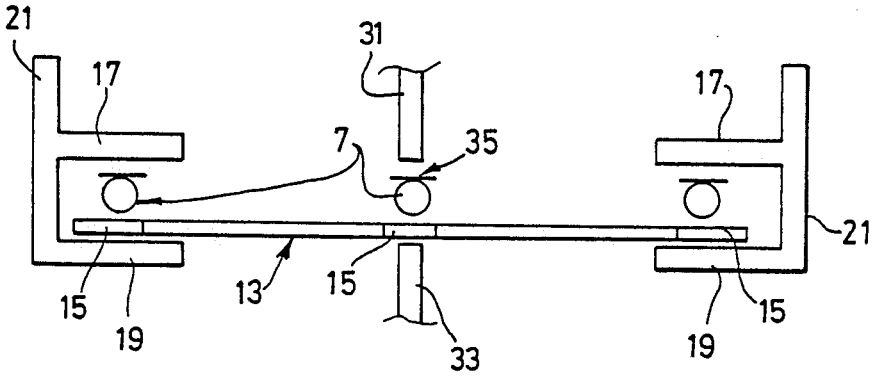
FIG. 6 is a schematic sectional view of the embodiment of FIG. 5 and a screen member mounted in a basket of vibratory apparatus.

As is shown in FIG. 6, the basket 21 provides upper and lower lateral projections 17, 19 by means of which expansion of the inflatable stocking 7 clamps the screen member to the basket 21. Additionally, the basket 21 has upper and lower support members 31, 33 in a manner similar to the arrangement of FIG. 4, midway between the two sides of the screen member, and the screen member has a portion of the screen frame 15 at this point, so that the middle arm of the E-shaped clamping device clamps the central portion of the screen member between the upper and lower support members 31, 33 of the basket 21.

As will be apparent to those skilled in the art, many further variations and embodiments of the clamping device of the present invention may be provided.

What is claimed is:

1. In a vibratory screening apparatus which includes a vibratory basket having two spaced lateral projections on the inside of its periphery and a screen member having a screen supported by a peripheral frame, the improvement of a separate and removable clamping device releasably clamping the screen member in the basket, the clamping device comprising:

a frame member and inflatable means carried by and located on said frame member, the peripheral frame of the screen member and the frame member of the clamping device both being located between the lateral projections of the vibratory basket with the inflatable means disposed against the peripheral frame of the screen member and the frame member pressed against one of the lateral projections; and means for inflating and deflating the inflatable means for releasably clamping the screen member in the vibratory basket, wherein said frame member is not unitarily fixed to either of said screen member or said basket.

2. An apparatus according to claim 1 in which the inflatable means comprises at least one elongate inflatable member extending along the length of the frame member.

3. An apparatus according to claim 2 in which the inflatable means extends around at least three sides of the frame member.

4. An apparatus according to claim 2 in which the inflatable member includes a portion located within the area defined by the frame member.

5. An apparatus according to claim 1 including a reservoir for inflation fluid exhausted from the inflatable means when it is deflated.

* * * * *